US005971423A

United States Patent [19]

Hansen et al.

[11] Patent Number: 5,971,423

[45] Date of Patent: Oct. 26, 1999

[54] BINDING FOR ATHLETIC GEAR

[75] Inventors: Reinhard Hansen, Salzburg; Werner Jettmar, Weiden am See, both of Austria; Leon Widdison, Laufen, Germany

[73] Assignee: Goodwell International Ltd., Tortola, Virgin Islands (Br.)

[21] Appl. No.: 08/730,811

[22] Filed: Oct. 17, 1996

[30] Foreign Application Priority Data

Oct. 17, 1995 [DE] Germany ..... 195 38 662

[51] Int. Cl.[6] ..... A63C 9/10

[52] U.S. Cl. ..... 280/634

[58] Field of Search ..... 280/617, 620, 280/621, 622, 625, 626, 633, 634, 607, 618, 623, 631, 632, 616, 11.3, 11.31, 11.36

[56] References Cited

U.S. PATENT DOCUMENTS 4,937,952 7/1990 Olivieri ..... 36/119

5,727,797 3/1998 Bowles ..... 280/14.2

FOREIGN PATENT DOCUMENTS

0610652A1 8/1994 European Pat. Off. ..... A63C 17/14

95/33534 12/1995 WIPO ..... A63C 9/08

WO 96/40390 12/1996 WIPO ..... A63C 9/08

*Primary Examiner*—Robert J. Oberleitner

*Assistant Examiner*—C. T. Bartz

*Attorney, Agent, or Firm*—Senniger, Powers, Leavitt & Roedell

[57] ABSTRACT

A binding for athletic gear having a retaining device for a shoe which consists of a heel element and an instep element pivotally mounted with respect to each other by means of a coupling device. The heel element and the instep element can pivot into an open position in which the shoe can be inserted into the retaining device, then pivot into a closed position in which the heel element and the instep element are held by a locking device and in which the shoe is securely attached to the athletic gear.

24 Claims, 8 Drawing Sheets

BINDING FOR ATHLETIC GEAR

BACKGROUND OF THE INVENTION

The invention pertains to a binding for athletic gear which attaches the shoe or foot of the user to the athletic gear. Athletic gear of the kind defined here is, for example, single-track roller blades (so-called in-line skates), other multiple-track roller skates, ski boots, snowboards, alpine skis, water skis, wind surfers and all other athletic gear in which a relatively tight connection is needed between the athletic gear and the shoe or foot of the user.

In the case of in-line roller blades, for example, like the kind known from EP 0610652 A1, a chassis is provided to which the rollers are mounted located in a row one behind the other. A shoe is permanently mounted to the chassis which extends out beyond the ankle of a foot inserted into the shoe, and consists of relatively rigid material, thereby ensuring a good mount. Externally, the shoe is provided with adjusting devices, by which the shoe can be adapted within tight limits to the individual shoe, where said adjusting devices can consist of known snap clamps, snap locks and stepped belts, or of cable locks, comparable with known ski boots, or a possible combination of these devices.

The shoe is securely attached by rivets to the chassis, so that removal of the shoe from the chassis is not possible. This results in the user having to use a special roller skate corresponding to his foot, such that these roller skates cannot be used by others with different shoe sizes. Likewise, a roller skate of this kind can be used by a growing person only as long as the person does not "grow out of the shoe."

Another disadvantage is the fact that when using these roller skates as a means of transportation, street shoes also have to be carried along, which the user must pull on after arrival at the destination, whereupon the cumbersome roller skates have to be carried. Therefore, the known, in-line roller skates have a use as athletic gear, but have disadvantages in everyday use as a means of transportation.

A similar problem comes up with ice skates, where the runner has to be riveted or screwed to the sole of a special shoe, so that, again, the user has to use a special ice skate fitted to his foot.

Even with other athletic gear, such as snowboards, the binding and the shoe have to be coordinated with each other, so that the user has very little option in selecting which shoe he uses, and in most cases the binding still has to be adjusted individually to a selected shoe.

SUMMARY OF THE INVENTION

Therefore, the purpose of the invention is to create a universal binding for athletic gear that is easy to handle and that gives the shoe or foot the hold necessary for the particular application.

An additional purpose of the invention is to create a binding that allows use by several users who can also have different shoe sizes.

This problem is solved by the properties stated in claim 1. Favorable configurations and refinements of the invention are found in the subclaims.

Briefly, therefore, the invention is directed to a binding for athletic gear. This binding comprises a retaining device for a foot or shoe, the retaining device having a heel element pivoting between an open position and a closed position, and an instep element pivoting between a closed position and an open position, whereby the heel element and the instep element in the open position form between them an opening for insertion of the shoe or foot and in the closed position they hold the shoe or foot. A coupling device is also provided which connects the heel element and the instep element so that they pivot against each other.

Additional objects and features of the invention will be in part apparent and in part pointed out hereinafter.

BRIEF DESCRIPTION OF THE DRAWINGS

The invention is explained in greater detail below based on the embodiment in conjunction with the figures. We have.

The same reference numbers in the individual figures denote the same are functionally equivalent parts.

DETAILED DESCRIPTION OF THE INVENTION

Figure 1:
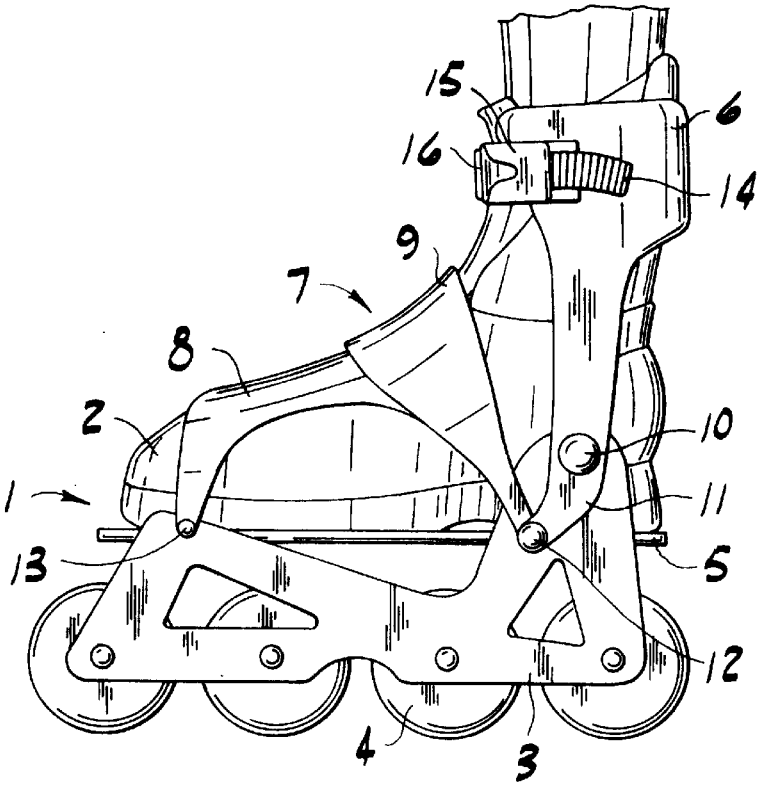
FIG. 1 A side view of the binding when used on an in-line roller skate in the closed position according to a first embodiment of the invention.

In this inventions a retaining device for a shoe is provided on the athletic gear, said device consisting essentially of a heel element and an instep element. The heel element and the instep element can pivot forward and backward with the athletic gear itself, e.g., its chassis, or by means of a mounting plate mounted under the athletic gear. Both elements are oppositely coupled to each other such that during a forward pivot of the heel element, the instep element pivots backward or is brought forcibly into a closure position. In several variants of the invention, the coupling also acts in the opposing, pivot direction.

In the former pivot, the retaining device is brought into a closed position, in which the inserted shoe or foot is tightly bound and held to the athletic gear. The contact force in this case depends on the pivot angle of the two elements, and can be adjusted by the user.

Conversely, by forward pivoting the instep element or by backward pivoting the heel element, the retaining device can be brought into an open position in which the heel element will pivot far enough backward and the instep element can pivot far enough forward, in order to insert the shoe or foot into the retaining device and to set down upon the athletic gear or its chassis. Due to the coupling device between the heel element and the instep element, only one of these elements needs to be operated in order to establish the open position.

The heel element surrounds the leg of the user in the closed position at the height of the shinbone. Proceeding from this region, it runs in the closed position essentially vertically downward on both sides of the athletic gear to a first pivot bearing in the chassis or the mounting plate in the heel region of the shoe and in an extension beyond, so that a lever is formed through which the heel element and the instep element are mounted in order to pivot opposite each other. This lever can also be beveled, so that the contact pressure of the lever on the coupled instep element can be varied according to the curvature. The heel element on both sides of the athletic gear is articulated directly at the chassis or at the mounting plate attached to the athletic gear, so that the lateral bending stability is increased.

The instep element is of a two-part design in one embodiment of the invention, consisting of an adjustable instep tongue connected in the region of the shot point to the athletic gear by means of a second pivot bearing, and in the closed position, runs along the instep and the clamped region of the shoe, up to the region of the user's shinbone, and features an instep belt, which surrounds the instep tongue in the clamp region of the shoe, and has an end on both sides of the shoe, through which the instep belt and thus the instep element and the lever of the heel element are coupled to pivot opposite each other.

In another embodiment of the invention, the instep element is of a one-part design, so that the coupling to the heel element and the articulation to the chassis and/or the mounting plate operate basically in the same way as in the two-part design.

A number of variants of the coupling device in the sense of this invention is possible. In addition to the coupling through lever and pivot bearing described above, a coupling through a gear attached to the lever or to the first pivot bearing of the heel element is possible, said gear having gear teeth that engage the gear teeth provided on the instep element. Another variant uses a cable attached to the lever and to the end of the instep belt and runs around a diverter roller secured to the chassis or the mounting plate. This variant causes an opposing, forced pivoting of the heel element and of the instep element, only during a pivot of these elements into the closed position of the retaining device, whereupon after a pivot into the open position, both elements have to be moved manually, since the cable will transfer tensile forces, but not pressure forces.

Furthermore, different variants of locking devices are provided that lock the elements of the retaining device in their closed position. One variant calls for provision of a belt or V-belt which is attached to the heel element and extends past the instep element. Locking takes place by-means of a snap-in-lock that locks a stepped belt which is clamped by a snap clamp. Another design provides a tie rod which is articulated in the heel region of the shoe to the chassis or to the mounting plate and runs into and snaps in a snap lock seated on the heel element. In another design, an articulated rod is connected to the heel element and to the chassis or the mounting plate, which moves an elbow lever accordingly across its dead point and locks the retaining device in the closed position. Another embodiment calls for the use on both sides of the shoe of a spring-tensioned bolt on the chassis or the mounting plate, said bolt rests against the edge of the lever in such a manner that it cannot be pivoted to the rear, whereupon after pressing in the bolt, the lever can slide away across the bolt and thus the heel element can pivot to the rear. Also, holes for snap in of the bolt can be provided on the lever.

All of these enumerated locking devices that connect and link the heel element and the instep element in the locked position can be adjusted so that the size of the opening between the heel element and the instep element and thus the tension force is variable. The stepped belt lock can be variably adjusted, just like the tie rod lock based on its gear teeth, which can snap into any snap lock at any particular position. The length of the articulated rod can be adjusted by varying the location of its articulation point, whereupon an adaptation of the closed position of the retaining device is effected by means of the cable by varying the attachment positions of the cable to the lever and to the end of the instep belt. The spring tensioned bolt, in turn, can slide within a recess in the chassis of the mounting plate and lock therein, so that the position where the lever is held by the bolt can be varied.

Furthermore, shock absorbers can be integrated into the locking mechanisms. For this purpose, the material of the belt or V-belt can be elastic to achieve the lock. In the variants with tie rod or the articulated rod, they can each have a spring block which gives these rods an elasticity in the longitudinal direction. Of course, other variants of a shock-absorbing lock are possible within the sense of this invention.

In addition, yet other possible means of adjustment can be used to adapt the binding to different shoe sizes and shapes. Firstly, the active height of the instep element can be adjusted, and secondly, the location of the coupling point between the heel element and instep element can be adjusted. Another possible adjustment in the frontal foot region of the instep element would be to have a slit in the instep element which is either open or could be sealed with a piece of rubber. Then a belt to adjust the instep element could be located above this slit.

Basically the binding only has to be adjusted one time for the corresponding size of the shoe and then remains unchanged. Due to the provisions for opening and flipping up the retaining device, no individual setting is required each time the shoe is pulled on.

In another variant of the invention, the heel element and the instep element are coupled together via sheathed cables and diverter rollers, such that when pivoting the heel element upwards into the closed positon, the instep element is pressed against the instep of the foot.

Finally, according to a refinement of the invention, the essential elements of the binding, particularly the pivoting heel elements and the instep element coupled to it, are integrated into the boot, which, in addition to easier entry into the boot, offers the considerable advantage that in a forward position of the user, that is, when he angles his shinbone forward in the direction of the toes, the instep element exerts an increased pressure on the instep of the foot and thus prevents lifting of the heel or even an involuntary stepping out of the shoe.

Even though the invention is explained below predominately in connection with its use on an in-line roller skate, it is expressly pointed out that the invention can be used universally on all athletic gear in which the shoe or foot of the user is held to the athletic gear. In many cases, athletic gear such as in-line roller skates, ice skates or similar items, the essential base elements of the binding are attached directly to the chassis of the athletic gear. But in the case of some athletic gear such as snowboards, skis, water skis, etc., these components are articulated at a mounting plate which is connected to the athletic gear, such as the snowboard, for example, by screws, and which has essentially vertically spaced bars to which the components of the binding are attached. Thus, this mounting plate has the same function, with regard to the operation of the binding, as the chassis of the in-line roller skate presented in the embodiments discussed below. All variants of the invention described herein can be applied in this regard universally to all kinds of athletic gear under discussion, and that the reference to in-line roller skates is by no means to be viewed as a limitation of the invention to this particular application.

First, with reference to FIG. 1, an in-line roller skate 1, hereinafter referred to as a roller skate 1, is shown in the closed position. The roller skate 1 has a retaining device to hold the shoe 2 in place, said retaining device is attached to a chassis 3 on which roll mounted rollers 4 are seated one behind the other. A smooth surface 5 is integrated into the chassis 3 or is attached thereon and the shoe 2 is seated upon said surface. The retaining device features a heel element 6 and a two-part instep element 7 which consists of an instep tongue 8 and an instep belt 9. The instep element 7 extends across the shoe 2 in the instep region and clamp region, whereas the heel element 6 surrounds the heel and a portion of the calf of the user on the side and rear. The heel element 6 is connected on both sides of the roller skate to the chassis 3 by means of a pivot joint 10. A portion of the heel element protruding downward over the pivot joint 10 forms a lever 11 through which the heel element 6 and the instep element 7 are linked by means of a connecting point 12. The front end of the instep element 7 in the travel direction is connected on both sides of the chassis 3 by means of one pivot joint 13 with the chassis 3. The heel element 6 and the instep element 7 are held in the closed position by locking mechanisms located in the shinbone region of the user at the heel element 6 and at the instep element 7; these locking mechanisms have a stepped belt 14 which is introduced into a snap lock 15 and snaps in there, whereby the stepped belt 14 is tensioned by a snap clamp 16 and the shoe 2 is securely grasped by the heel element 6 and the instep element 7 and is held onto the smooth surface 5.

Figure 2:
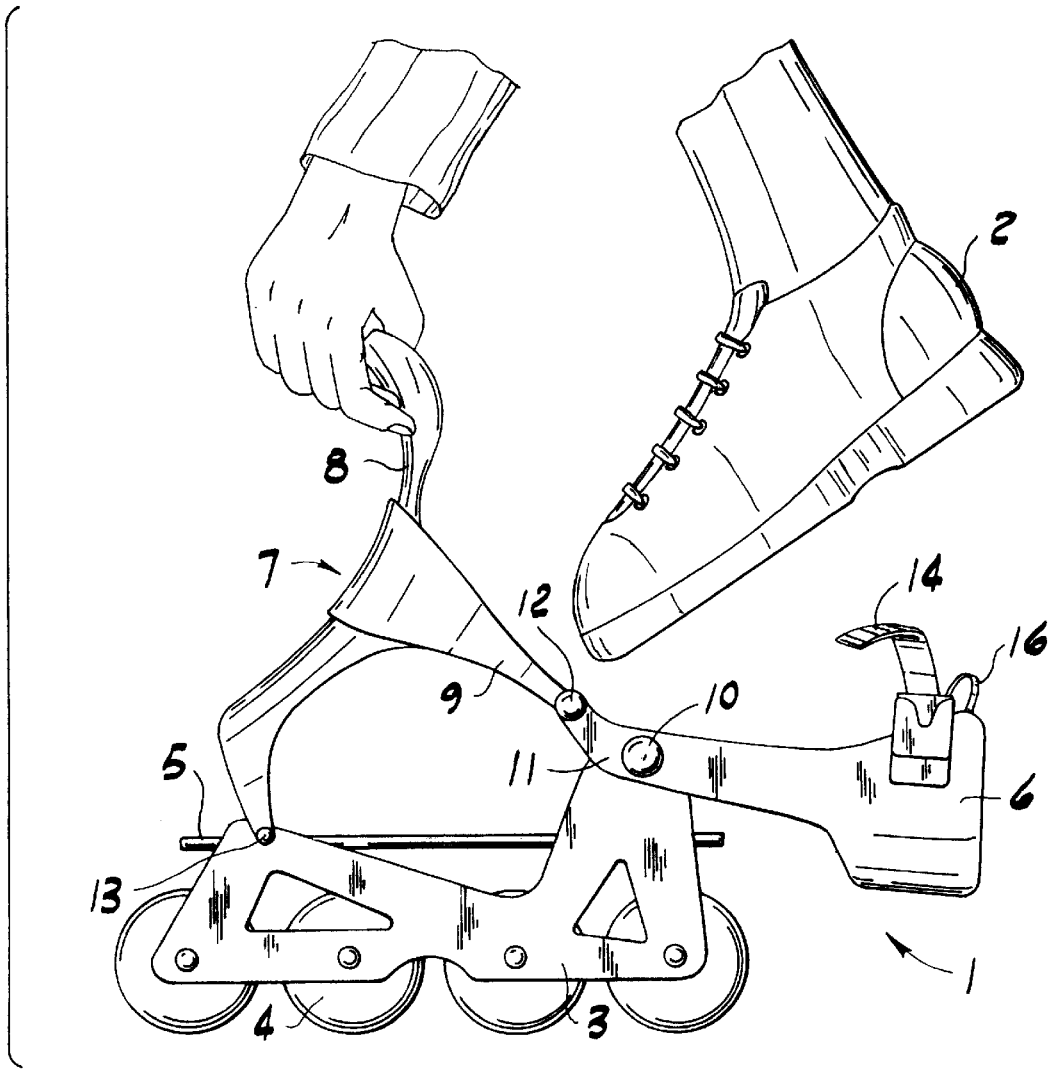
FIG. 2 A side view of the binding of FIG. 1 in the open position.

FIG. 2 shows the binding in the open position. In this position the heel element 6 will pivot backward by means of the pivot joint 10 and the instep element 7 will pivot forward by means of the pivot joint 13, whereby the heel element 6 is located essentially horizontal and the instep element 7 is located in an approximately vertical position, so that an entry opening is formed between the heel element 6 and the instep element 7, which is large enough so that the shoe 2 can be inserted essentially at a slant from above and can be set onto the surface 5. By means of the lever 11 and the connecting point 12, the instep element 7 is connected to the heel element 6 such that it is necessary to merely pivot either the instep element 7 forward (back), or the heel element 6 backward (forward) in order to achieve the open position (closed position), since, due to the coupling of the heel element 6 and of the instep element 7, the particular element not pivoted manually, will pivot in the other, opposite direction.

Figure 3:
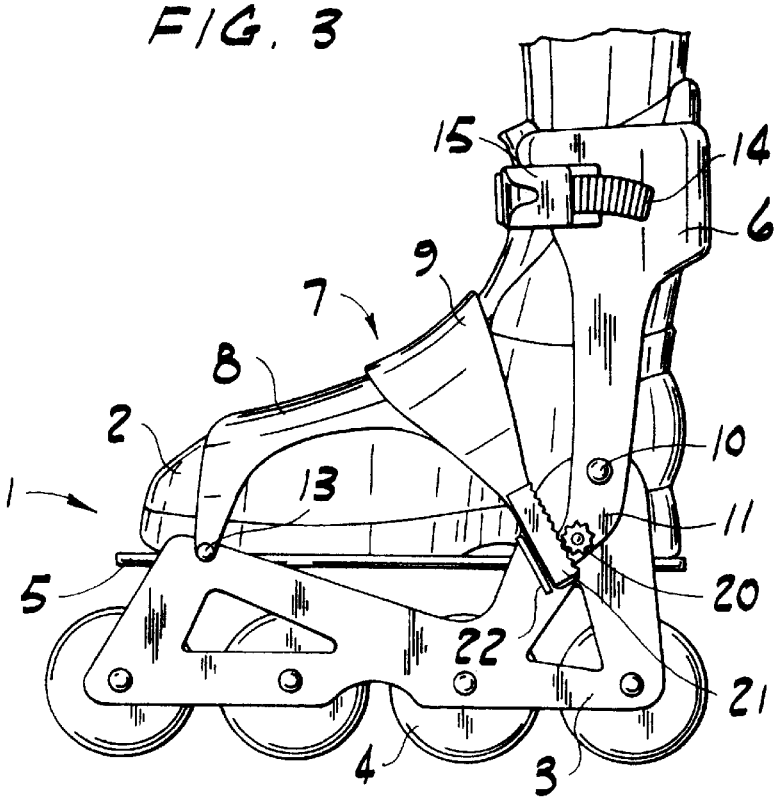
FIG. 3 A side view of the binding when used on an in-line roller skate according to a second embodiment with a coupling of the heel element and of the instep element by means of a gear wheel and an opposing toothed piece.

FIG. 3 shows the opposing coupling of the heel element 6 and of the instep element 7 by means of a toothed gear 20 attached on both sides of the roller skate 1 to the lever 10 and a toothed counterpiece 21 attached at the end of the instep belt 9 connected with the toothed gear 20. In order to ensure that the gear teeth of the toothed gear 20 constantly engage in the gear teeth of the toothed, counterpiece 21, the instep belt 9 must be rigid enough not to deform during a pivot process such that the gear teeth of the toothed gear 20 and of the toothed, opposing piece 21 lose contact. In addition, the toothed counterpiece 21 preferably runs through a guide bar 22 provided at the chassis 3 and contacting the toothed counterpiece 21. During a pivot process, said guide bar supports the toothed counterpiece 21, while it moves along the guide bar 22 relative to the toothed gear 20.

Figure 4:
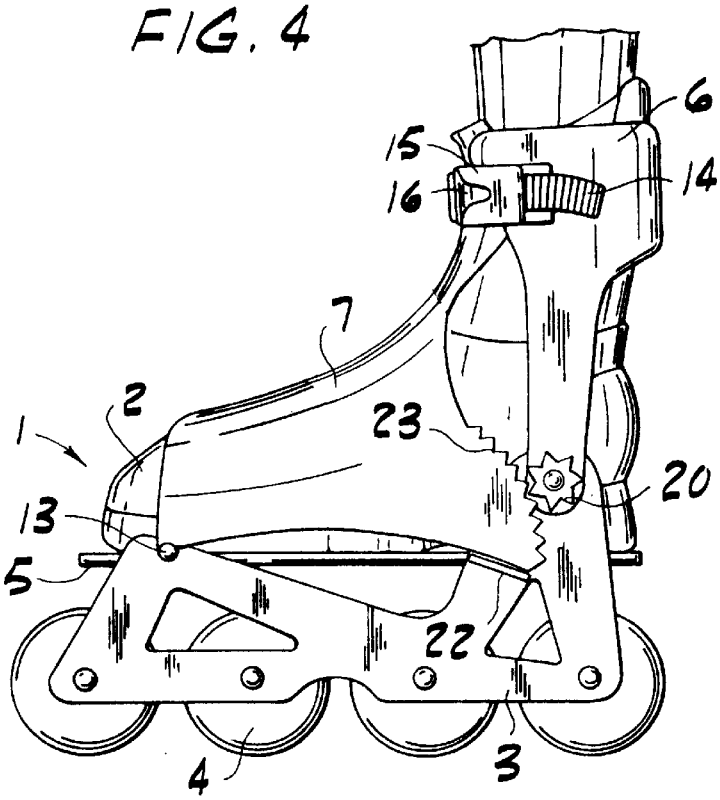
FIG. 4 A side view of the binding according to a third embodiment example with a coupling of the heel element and of the instep element by means of a gear wheel and a toothed instep element.

FIG. 4 shows the opposing coupling by means of the toothed gear 20 in another embodiment. The toothed gear 20 is directly attached to the pivot joint 10, whereby the gear teeth of the toothed gear 20 engages into a gear tooth 23 at the upper, rear edge of the instep element 7. The gear tooth 23 has bulge so that the gear 20 will always engage into the teeth 23. In addition, the guide bar 22 in contact with the lower edge of the instep element 7 can likewise be provided at the chassis 3, so that the section of the instep element bearing the tooth 23 is braced and during its movement it is guided along the guide bar 22.

Figure 5:
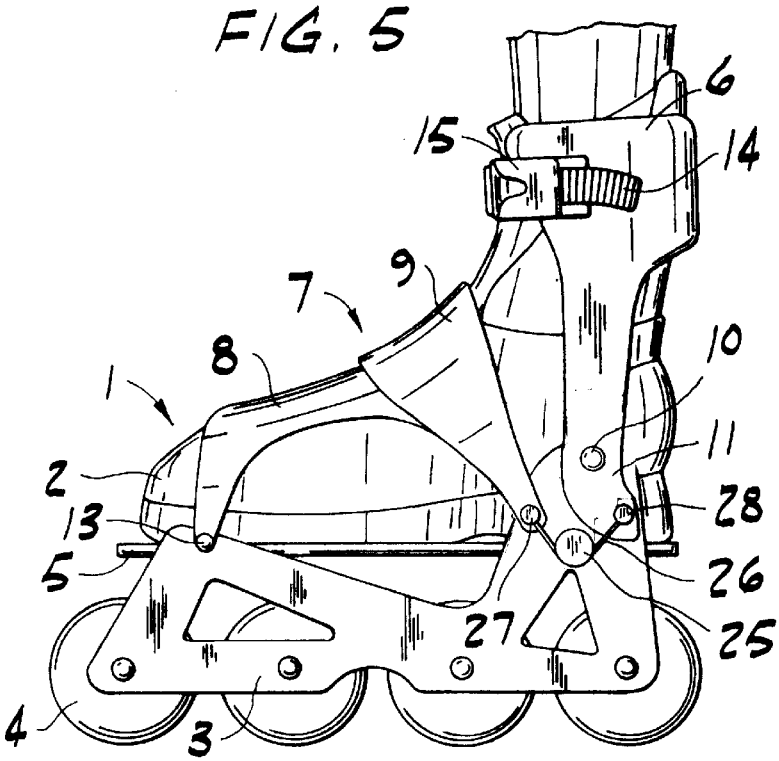
FIG. 5 A side view of the binding according to a fourth embodiment with a coupling of heel element and instep element by means of a cable running around a diverter roller.

FIG. 5 shows the configuration of the mutual coupling by means of a cable 26 running around a diverter roller 25; one end of said cable is attached to a mount 27 at the heel element 6 and its other end is attached to one mount 28 at the instep element 7. The diverter roller 25 is positioned to the chassis 3 so that the heel element 6 and the instep element 7 are linked to pivot opposite each other. Because the cable 26 is only able to transfer tensile forces but not compression forces, an opposing, forced pivoting will only take place when pivoting the heel element 6 or the instep element 7 into the closed position of the retaining device. During a pivot into the open position of the retaining device, both the heel element 6 and also the instep element 7 are pivoted manually.

Figure 6:
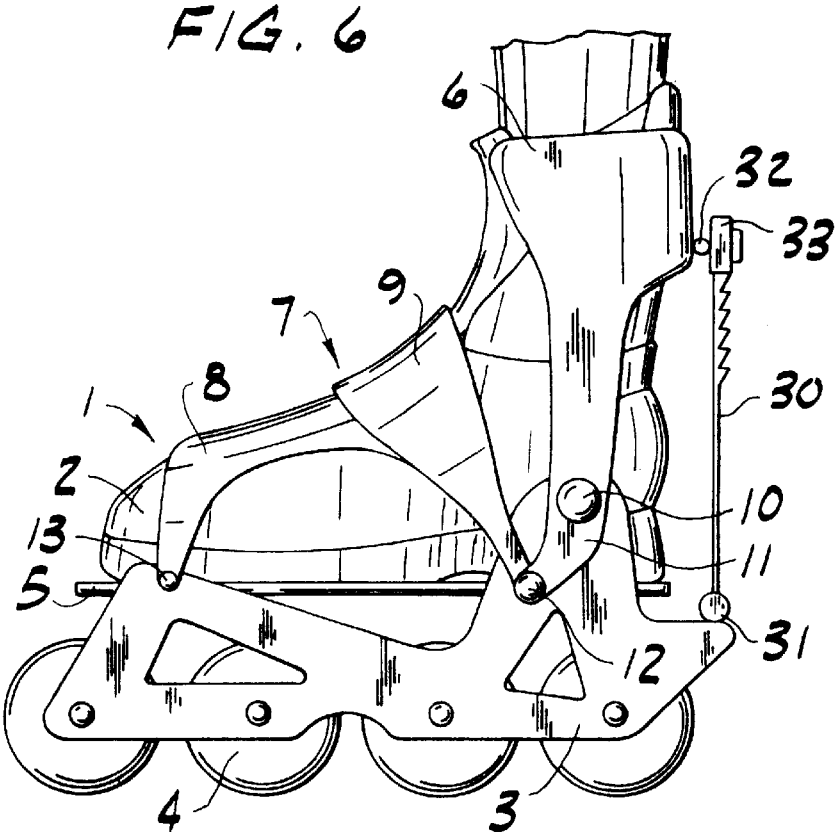
FIG. 6 A side view of the binding according to one variant of the invention with a locking of the closed position by means of a tie rod.

FIG. 6 showing the locking of the closed position in one variant by means of a tie rod 30, which is connected by means of a joint 31 to the chassis 3, and which is inserted into a snap lock 33 connected by a joint 32 with the heel element 6 and is locked. The gear teeth of the tie rod 30 is aligned so that the heel element 6 snaps into the closed position in the snap-in lock 33 desired by the user. If the heel element 6 is to pivot into the open position, then the snap-in lock 33 will release, so that the gear teeth of the tie rod 30 can slide through it and thus the heel element 6 can pivot backward. To pivot the heel element 6 into the closed position, the snap-in lock 33 need not be detached, since the gear teeth of the gear 30 are aligned, as mentioned, so that it can slide in this pivot direction through the snap-in lock 33 and engage in the desired, closed position.

Figure 7:
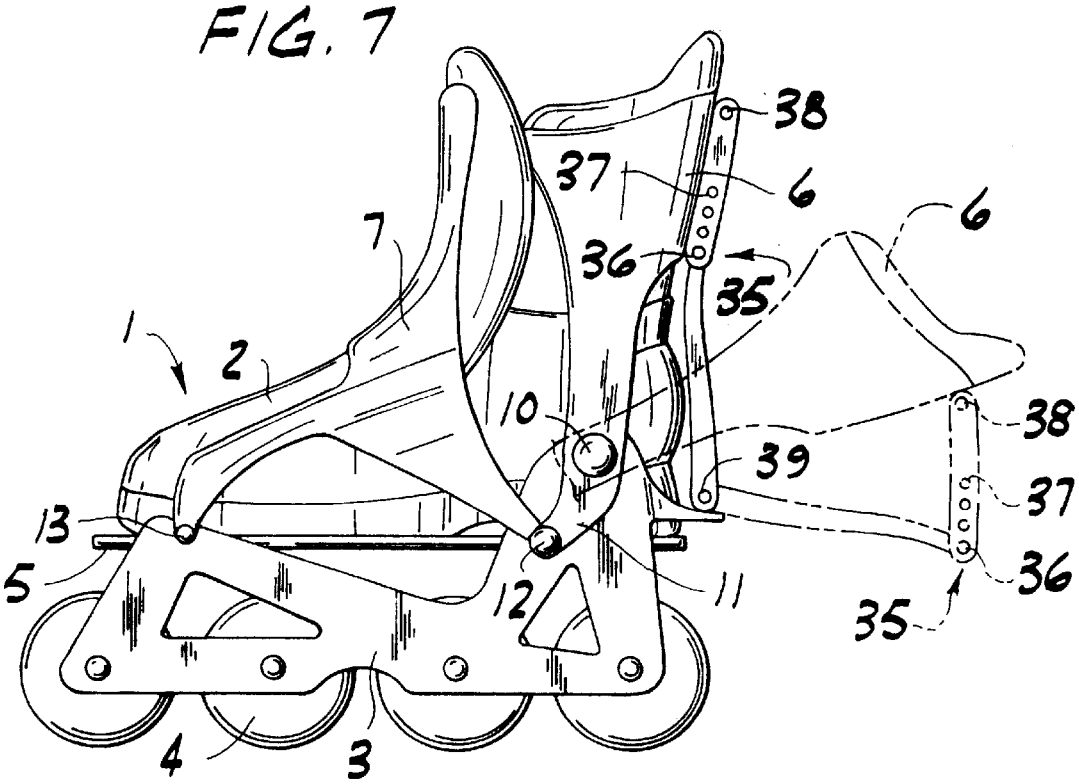
FIG. 7 A side view of the binding according to another variant with a locking of the closed position by means of an articulated rod.

Another variant shown in FIG. 7 shows an articulated rod 35 that consists of two elements which are connected together by means of a knee joint 32, whereby holes 37 are provided in one or both of the elements, so that the position of the knee joint 36 connecting the two elements, and thus the length of the articulated rod 35 can be varied. The articulated rod 35 is connected by means of a joint 38 with the heel element 6 and is connected by means of a joint 39 with the chassis 3. If the heel element 6 is to pivot into the open position, then the articulated rod 35 must be moved to the rear by means of the knee joint 36. During a pivot of the heel element 6 into the closed position, the articulated rod 35 will move, corresponding to a knee lever, across the knee joint 36 in the direction of the heel element 6 across a dead point, so that the heel element 6 and thus the instep element 7 connected to it are locked in the closed position.

Figure 8:
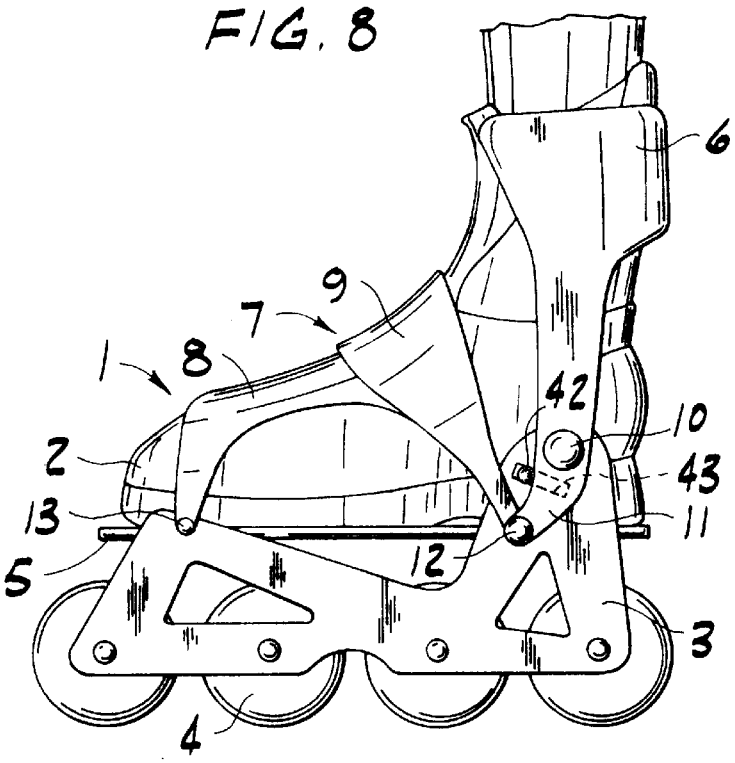
FIG. 8 A side view of the binding according to yet another variant with a locking of the closed position by means of a snap-in bolt.

FIG. 8 shows an additional variant of the locking device, which has on both sides of the chassis 3 a spring-tensioned bolt 42, which can slide into and be locked within a recess 43 in the chassis 3, so that its position within the recess 43 is adjustable. This spring-tensioned bolt 42 is used as a stop for the front edge of the lever 10 underneath the articulation point 11, so that the heel element 6 cannot pivot backward in the locked position. If the spring-tensioned bolt 42 is pressed against the spring force into the chassis 3, then the lever 11 of the heel element 6 can move out past the bolt 42, so that the heel element 6 can pivot downward. A configuration differing from FIG. 8 provides for a spring-tensioned bolt not located in the chassis 3, but rather in the lever 11, so that in the closed position of the retaining device it comes to rest against the stop within the recess in the chassis 3 and locks the heel element 6.

Figure 9:
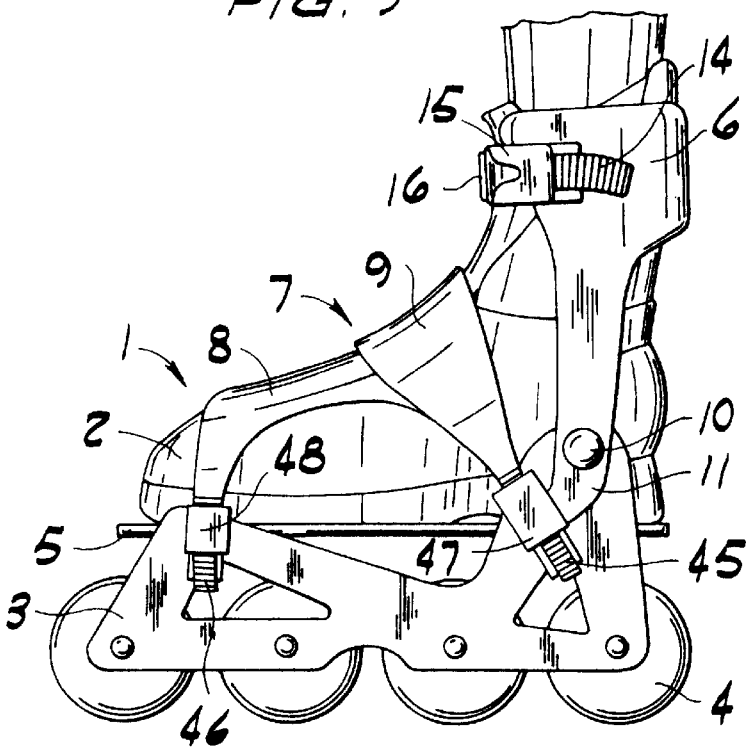
FIG. 9 A side view of the binding according to another variant with the position of the instep element adjustable by means of a stepped belt.

FIG. 9 shows adjusting devices of the instep element 7 which has a stepped belt 45 on at least one of the two sides of the chassis 3 at the end of the instep tongue 8, and a stepped belt 46 at the end of the instep belt 9, which are run through a snap lock 47 and a snap lock 48, which are provided at the articulation point 13 of the instep element 7 or the instep tongue 8 at the chassis 3 and at the connecting point 12 of the instep element 7 or of the instep belt 9 and the heel element 6. If the named snap-in locks are released, then the stepped belts can be moved therein and can be displaced and then locked in the desired position. Thus, the instep element 7 or the instep tongue 8 and the instep belt 9 can be adapted individually to each user, which enables the use of different shoes by different users. In addition, the stepped belts can be equipped with snap clamps which allow tensioning of the stepped belts corresponding to known ski boot locks. This setting need only be performed once, as long as the user is using the same shoe.

Figure 10:
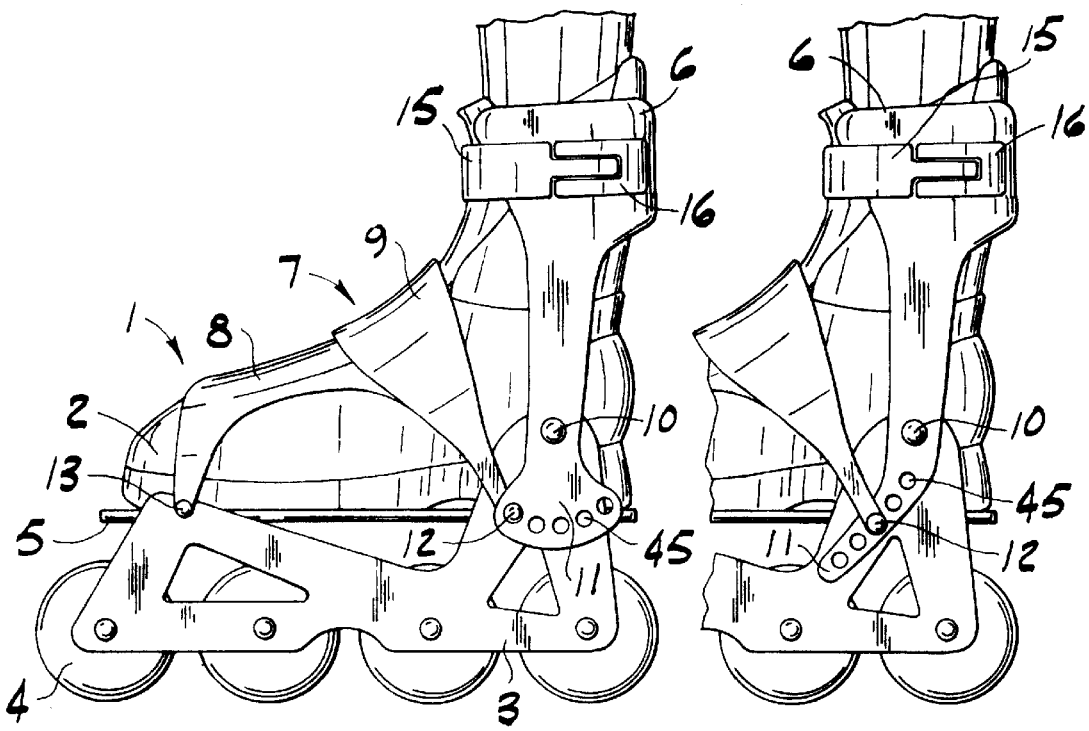
FIG. 10 A side view of the binding according to one variant of FIG. 1 with an adjustable coupling of the heel element and of the instep element by means of holes provided in the lever.

FIG. 10 shows adjusting devices in an additional design for changing the position of the connecting point 12, through which the heel element 6 is connected with the instep element 7. Holes 45 are provided in the lever 10 of the heel element 6, through which the instep element 7 can be coupled relative to each other in various positions at the heel element 6. In one design example, the lever 10 is semicircular shaped and the holes 45 are located in the circumferential direction therein, but where in another embodiment, the holes 45 are arranged in the radial direction with respect to the articulation point 11.

Figure 11:
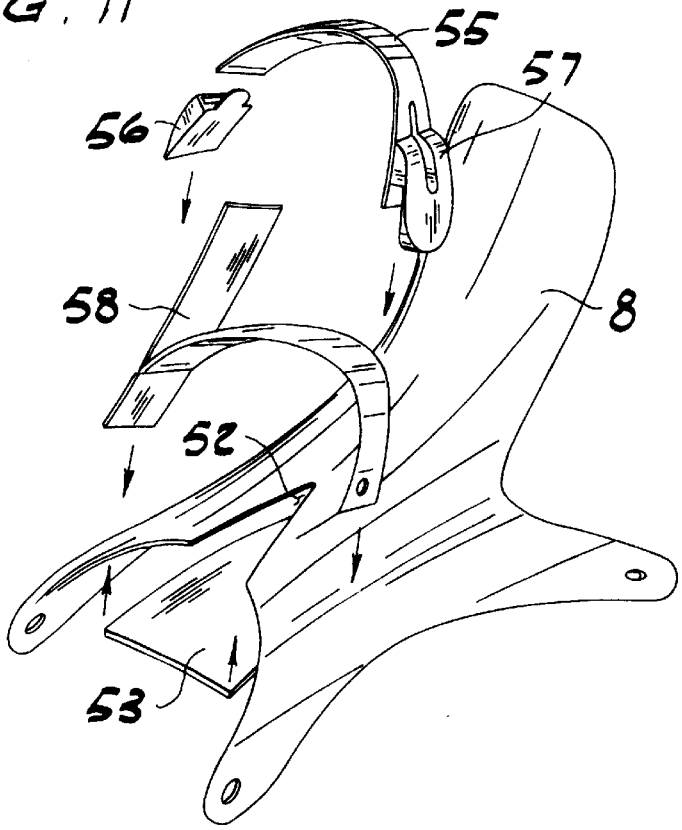
FIG. 11 A perspective view of the instep tongue with a recess and an insert to be inserted therein.

FIG. 11 shows one embodiment of the instep tongue 8 for a two-part configuration of the instep element 7, which features a recess 52 in which an elastic inlay 53 can be installed. To the side of the recess there is an adjusting device consisting of a toothed belt 55, a snap lock 56, a snap clamp 57 and a connecting piece 58, by means of which the instep tongue 8 can be better adapted in the region of the recess 52 to the shape of the shoe 2.

Figure 12:
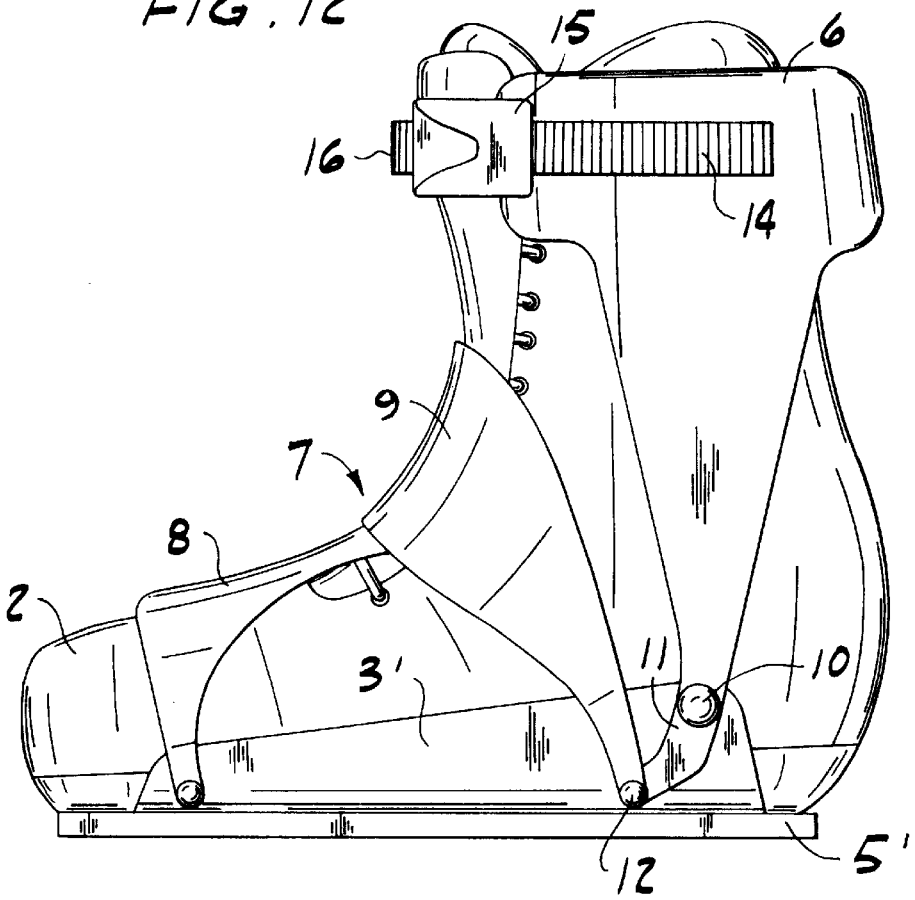
FIG. 12 A side view of the binding similar to FIG. 1, which can be used, in general, for all kinds of athletic gear, such as snowboards.

FIG. 12 shows the universal shape of the binding mentioned above, which is suitable for all athletic gear discussed, particularly for snowboards; regarding the fundamental function, the binding essentially corresponds to the embodiment of FIG. 1. The smooth surface 5, which in the embodiment of FIG. 1 can be attained by a plate integrated into the chassis, is replaced here by a smooth mounting plate 5', which is connected with the athletic gear, for example, to the snowboard with screws. The chassis 3 of FIG. 1 is thus created by bars 3' spaced on the two sides of the shoe extending vertically from the plate 5', which can also be molded as a single piece to the mounting plate 5'. Thus, the mounting plate 5' with the rods 3' can have the cross section of a U-tube profile. But it is also possible, such as known for example in the so-called Baseless binding, to use one separate mounting plate on each side of the shoe, with vertically protruding bars, whereby these bars have an L-shaped profile and the mounting plate 5' directly connected with the snowboard is attached to the side, next to the shoe, so that the shoe sole is resting directly upon the snowboard. Otherwise, the design example of FIG. 12 agrees with that of FIG. 1.

Figure 13:
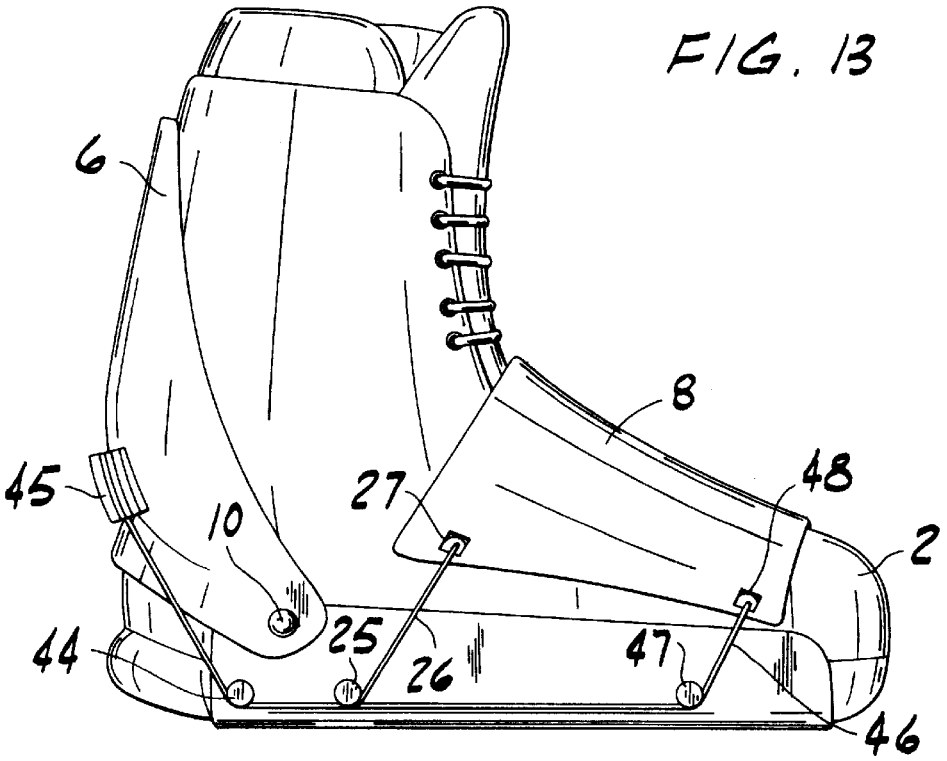
FIG. 13 A side view of the binding according to another embodiment with a coupling of heel element and instep element by one or more tension elements, such as cables.

FIG. 13 shows a modified variant of FIG. 5, which the heel element 6 and the instep element 8 are likewise coupled by tension elements or cables. Specifically, at the end of the instep element 8 facing the heel a fastener 27 is provided to which a tension element, such as a cable 26, is fastened. This runs from the fastener 27 to a diverter roller 25 that is mounted on a chassis 3 and offset backwards towards the heel with respect to the fastener 27. From there, the cable 26 runs to an additional diverter roller 44 that is opposite to diverter roller 25 and offset even further backwards in the direction of the heel and from there at an incline upwards to the heel element 6, where the cable 26 is attached to the heel element 6 by means of a fastener 45. The fastener 45 can contain an adjustment device such as a Rendel screw, by means of which the effective length of the cable 26 can be adjusted.

The diverter rollers 25 and 44 are arranged offset with respect to the pivot joint 10 of the heel element 6. In that way, in the upward pivoting of the heel element 6 into the flow position, the fastener 27 can be pulled downward at an incline in the direction of the diverter roller 25, by which the instep element 8 is pulled into a closed position, whereby it presses against the instep of the shoe or foot.

According to a refinement of the invention, the front end of the instep element 8 pointing toward the end of the foot is similarly coupled by means of a fastener 48, an additional tension element 46 and a diverter roller 47. The diverter roller 47 is likewise offset with respect to the fastener 48 in the direction of the heel, analogously to the offset between the fastener 27 and the diverter roller 25. The cable 46 can be guided to the fastener 45, whether separately or via the diverter roller 44. It can also be joined to the cable 26 between the diverter rollers 44 and 25 and from this joining point as only one single cable via the diverter roller 44 to the fastener 45.

The arrangement of the cables 26 and 46 with the fasteners 27 and 48 as well as the diverter rollers 47, 25 and 44 can be present only on one side of the binding. It can also be present on both sides. In the latter case, the instep element 8 is pulled down in its entirety in the closing of the binding, whereas with cables on one side is only deformed within itself and, to a certain extent, pivoted about an axis running parallel to the longitudinal axis of the boot.

By virtue of the fact that the diverter roller 25 and 47 are arranged offset backwards with respect to fasteners 27 and 46, the instep element 8 is moved during closing, not just downward in the direction of the shoe sole, but also backwards at an incline in the direction of the heel, whereby the shoe is pressed backwards in the direction of the heel element 6 and makes solid contact there.

Figure 14:
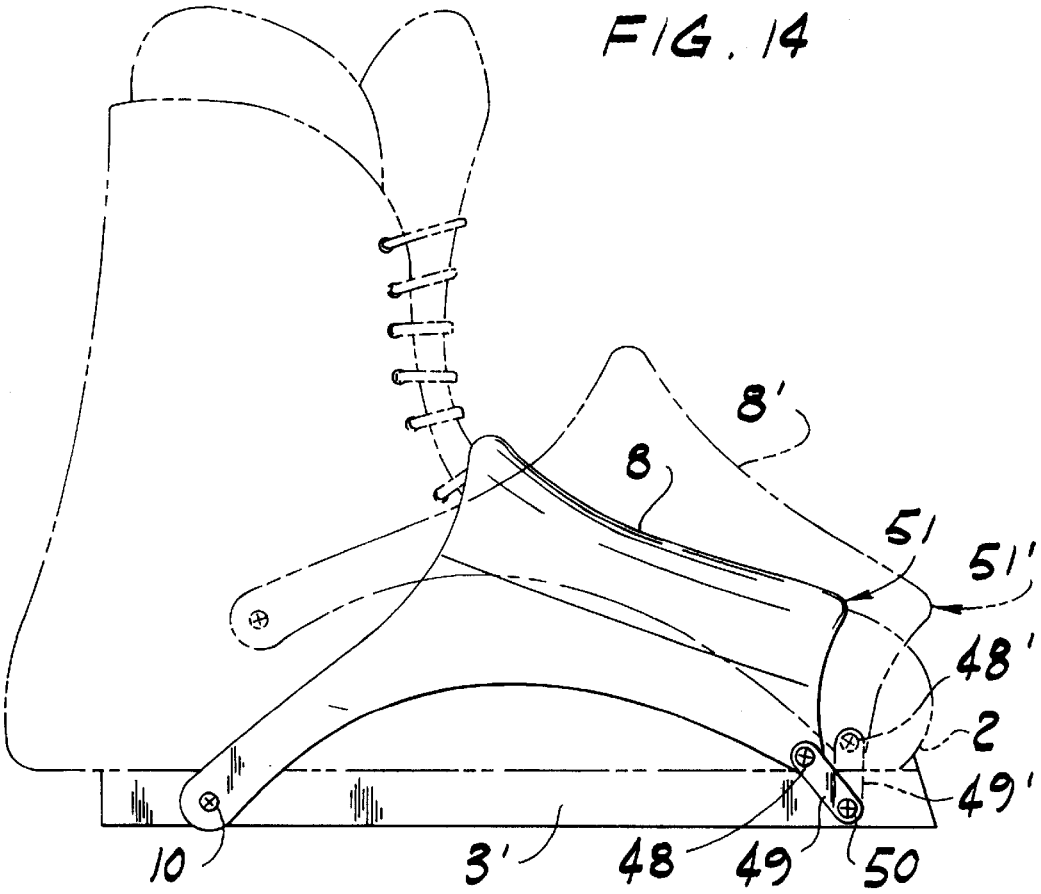
FIG. 14 A detail view of the fastening of the instep element to the chassis in a closed position and an opened position.

FIG. 14 shows a refinement of the invention in which the fastening of the front end of the instep element 8 is pivotable and thus adjustable in height. In the embodiments of FIGS. 1 to 10 and 12, the following problem appears: if one pivots the instep element 8 about the joint 13 into the opened position, the front edge 51 of the instep element 8 (FIG. 14) is lowered, whereby the opening for the penetration of the shoe tip is narrowed and the shoe cannot be quite be pushed forward into the proper position. If the instep element is then pivoted downwards into the closed position, then the front edge 51 of the instep element 8 moves upward and again reveals the shoe tip in this area, instead of holding it more firmly in place by the closing motion of the instep element 8.

To eliminate this secondary problem, the lower front end of the instep element is connected by means of a lever 49 that has pivot joints 48 and 50 at both ends to the chassis 3'. In FIG. 14, the opened position of the instep element 8 is indicated by hatch marks. The lever 49' is pressed forward by the introduction of the foot into the instep element 8' in the direction of the boot toe while pivoting about the joint 50. The pivoting motion of the lever is limited by a stop such that the lever 49 can move only as far as into the vertical position. In that way the joint 48 is moved into an elevated position 48' and the tip 51 of the instep element 8 is likewise raised, specifically, into position 51'. When closing the binding, the instep element 8 is pivoted into the position indicated by solid lines, while simultaneously the lever is also pivoted about the joint 50 from the position 49' into the position 49, whereby the tip 51 is moved from the position 51' into the position 51 and is thereby lowered.

According to a refinement of the invention, it is possible to prestress the lever 49 by a spring into the vertical position 49'. It is also possible, however, to design the lever as a whole to be flexible and to provide a solid fixation of the flexible lever 49 instead of the pivot joint 50.

Figure 15:
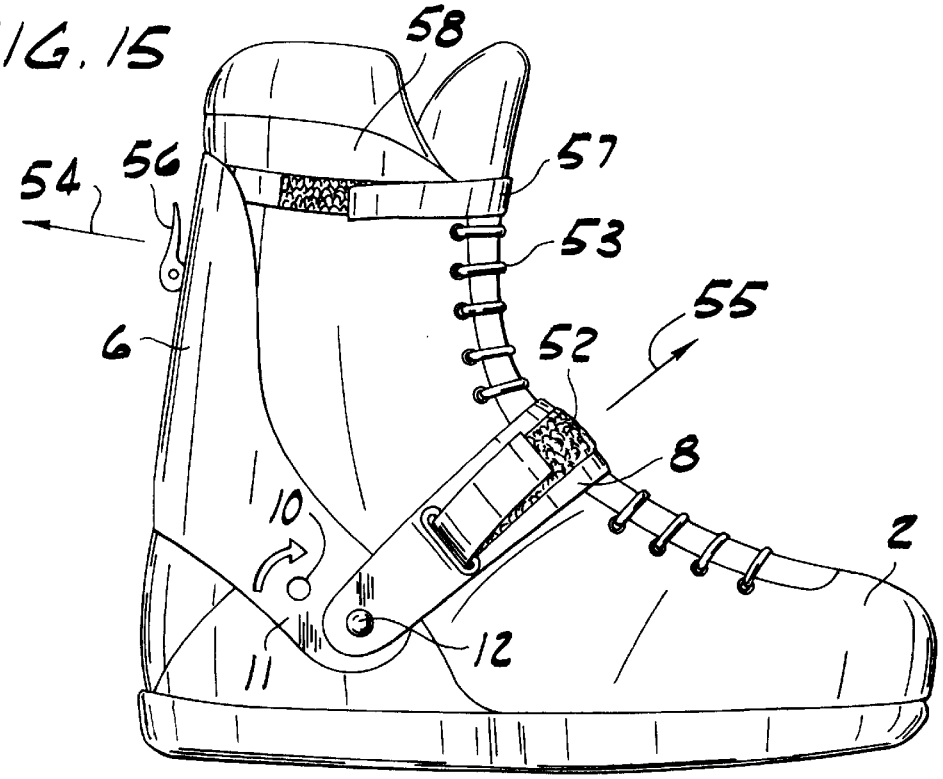
FIG. 15 A side view of the binding with integrated boot.

FIG. 15 shows how the elements of binding and shoe can be integrated together by fastening the heel element 6 and the instep element 8 directly to the shoe 2. The heel element is also fastened here about a pivot joint 10 seated on the shoe 2. The instep element 8 is fastened analogously to the embodiments of FIGS. 1, 2, and 7 to 12 via a joint 12 to a lever 11 of the instep element, with the joints 10 and 12 being mutually offset. The length of the instep element 8 can be individually adjusted in length by means of a belt 52 having, for instance, a Velcro closure. Upon entry into the boot, with its lacing 53 still open, the heel element 6 can be pivoted backward in the direction of the arrow 54, whereby at the same time the instep element 8 is loosened in the direction of the arrow 55. In that way, entry into the boot is made easier. If the boot is then closed and the user pivots the heel element 6 upward against the direction of the arrow 54, then, at the same time, the instep element 8 is pressed against the instep of the foot, opposite to the direction of the arrow 55. The instep element can then be held in place in the upper limit position by a lever 56. Additionally, the instep element 6 can be fastened to the boot shaft 58 by a belt 57, which can, for instance, be a toothed belt similar to the belts 14 of FIG. 1 or a belt with a Velcro closure. In case the user moves into the "forward position," the heel element 6 is pivoted forward together with the shaft 58. The instep element 8 thereby is pressed more strongly against the instep of the foot, so that the foot is held in place more effectively in the shoe and the heel of the foot cannot be raised inside the shoe. The shoe having the essential elements of a binding can be fastened in any given conventional manner, for instance, by straps or other conventional means, not shown, which fasten a shoe to sporting gear.

As various changes could be made in the above constructions without departing from the scope of the invention, it is intended that all matter contained in the above description and shown in the accompanying drawings shall be interpreted as illustrative and not in a limiting sense.

What is claimed:

1. A binding for athletic gear, said binding comprising a chassis and a retaining device for a foot or shoe having a toe end, an instep, and a heel end, said retaining device having a heel element pivoting between an open position and a closed position about a pivot joint, and an instep element pivoting between a closed position and an open position about another pivot joint, the instep element having a front end adapted to be positioned proximate the toe end and a rear end adapted to be positioned proximate the instep, whereby the heel element and the instep element in the open position form between them an opening for insertion of the shoe or foot and in the closed position they hold the shoe or foot, and a coupling device which connects the heel element and the instep element so that they pivot against each other, the coupling device having a diverter roller attached to the chassis of the binding and a tension element fixedly attached to the instep element and to the heel element and arranged to engage the diverter roller when the heel element and instep element are moved from the open position to the closed position.

2. The binding for athletic gear according to claim 1 wherein the front end and the rear end of the instep element are coupled to the heel element via tension elements and diverter rollers associated with the tension elements, wherein the diverter rollers are arranged offset opposite the pivot joint of the heel element.

3. The binding according to claim 2 wherein the length of the tension elements can be changed continuously.

4. The binding of claim 2 constituting a snowboard boot binding.

5. The binding of claim 3 constituting a snowboard boot binding.

6. The binding of claim 1 wherein the front end of the instep element is fastened to a chassis of the binding by means of a lever so as to pivot, and wherein a pivot joint connecting the lever and the front end of the instep element occupies an elevated position with respect to the sole of the shoe in the open position of the binding, and a lowered position in the closed positnon of the binding.

7. The binding of claim 6 wherein the lever is held by a catch in a position perpendicular to the sole of the shoe in the opened position of the binding.

8. The binding of claim 6 constituting a snowboard boot binding.

9. The binding according to claim 1 wherein the heel element, the instep element and the coupling between the heel element and the instep element are integrated into a shoe.

10. The binding for athletic gear according claim 1 characterized wherein the heel element in the open position is in an essentially horizontal position.

11. The binding for athletic gear according to claim 10 wherein a locking device is provided which locks the heel element and the instep element in the closed position, whereby the heel element in the closed position is in an essentially vertical position.

12. The binding for athletic gear according to claim 11 wherein the locking device has in the upper region of the heel element and of the instep element, a snap clamp, a first stepped belt connected to the snap clamp and a first snap lock, which can lock the heel element and the instep element in the closed position.

13. The binding for athletic gear according to claim 11 wherein the locking device has a tie rod articulated to the mounting plate on the outside of the heel element and connected to the heel element, where the connection of the tie rod and the heel element takes place by means of a second snap lock which is articulated in the upper region of the heel element.

14. The binding for athletic gear according to claim 11 wherein the locking device has at the outside of the heel element an articulated rod with adjustable length, which is articulated in the upper region of the heel element and in the rear region of the mounting plate, whereby the articulated rod has a knee joint that is used to bring the articulated rod across a dead point in the direction of the heel element into the closed position.

15. The binding for athletic gear according to claim 11 wherein a spring-tensioned bolt is provided which can slide within a recess and can be mounted in place therein, through which the heel element and the instep element are locked in the closed positions.

16. The binding according to claim 1 wherein the tension element is fixedly attached to the rear end of the instep element.

17. The binding according to claim 16 wherein the tension element constitutes a first tension element, the binding further comprising a second tension element running across the diverter roller to the heel element.

18. The binding according to claim 16 wherein the tension element constitutes a first tension element and the diverter roller constitutes a first diverter roller, the binding further comprising a second tension element running across a second diverter roller to the heel element.

19. The binding according to claim 17 wherein the second tension element is fixedly attached to the front end of the instep element.

20. The binding according to claim 16 wherein the diverter roller constitutes a first diverter roller, the binding further comprising a rearward diverter roller across which the tension element runs, the rearward diverter roller positioned rearward of the first diverter roller.

21. The binding according to claim 20 wherein the tension element constitutes a first tension element, the binding further comprising a second tension element running across a second diverter roller to the heel element.

22. The binding of claim 1 constituting a snowboard boot binding.

23. The binding of claim 10 constituting a snowboard boot binding.

24. The binding for athletic gear according to claim 1 wherein the rear end of the instep element is coupled to the heel element via tension elements and diverter rollers associated with the tension elements, wherein the diverter rollers are arranged offset opposite the pivot joint of the heel element.

* * * * *